US010709920B2

(12) United States Patent
Hopkins et al.

(10) Patent No.: US 10,709,920 B2
(45) Date of Patent: Jul. 14, 2020

(54) JUMP ROPE HANDLE HAVING ROPE HINGE

(71) Applicant: Web Guidz, LLC, Wenatchee, WA (US)

(72) Inventors: Matthew Thomas Hopkins, Leavenworth, WA (US); Mark Alan Franklin, Bozeman, MT (US); Stephen Mark Sanford, Bozeman, MT (US); Ross Forrest Walker, Belgrade, MT (US)

(73) Assignee: Web Guidz, LLC, Wenatchee, WA (US)

( * ) Notice: Subject to any disclaimer, the term of this patent is extended or adjusted under 35 U.S.C. 154(b) by 146 days.

(21) Appl. No.: 16/002,140

(22) Filed: Jun. 7, 2018

(65) Prior Publication Data

US 2018/0361187 A1 Dec. 20, 2018

Related U.S. Application Data

(60) Provisional application No. 62/522,632, filed on Jun. 20, 2017.

(51) Int. Cl.
*A63B 5/20* (2006.01)
*A63B 21/00* (2006.01)

(52) U.S. Cl.
CPC ..... *A63B 5/20* (2013.01); *A63B 21/4035* (2015.10)

(58) Field of Classification Search
CPC .... A63B 5/00; A63B 5/04; A63B 5/20; A63B 5/205; A63B 5/22; A63B 15/00; A63B 15/005; A63B 21/0004; A63B 21/00043; A63B 21/00058; A63B 21/00069; A63B 21/00072; A63B 21/00076; A63B 21/012; A63B 21/0125; A63B 21/015; A63B 21/018; A63B 21/0608; A63B 21/068; A63B 21/08; A63B 21/15; A63B 21/151; A63B 21/152; A63B 21/159; A63B 21/22; A63B 21/4023; A63B 21/4027; A63B 21/4033; A63B 21/4035; A63B 21/4041;

(Continued)

(56) References Cited

U.S. PATENT DOCUMENTS 5,399,042 A 3/1995 Ivel
5,607,248 A 3/1997 Hasse
(Continued)

OTHER PUBLICATIONS

DEGOL Skipping Rope Tangle-Free with Ball Bearings Rapid Speed Jump Rope Cable (Year: 2019).*

*Primary Examiner* — Gary D Urbiel Goldner
(74) *Attorney, Agent, or Firm* — Jaffery Watson Mendonsa & Hamilton LLP

(57) ABSTRACT

Jump rope handles are described. In an embodiment, a speed rope includes a handle having a head rotationally coupled to a grip to rotate about a first axis, and a rope hinge rotationally coupled to the head. The rope hinge has a single degree of freedom relative to the head, and the single degree of freedom can be rotation of the rope hinge about a second axis. The rope hinge may include a cylindrical outer surface mounted in a pivot hole of the head to constrain movement of the rope hinge to rotation about the second axis. Accordingly, a rope held by the rope hinge can pivot about the second axis while simultaneously swinging around the first axis. Other embodiments are also described and claimed.

20 Claims, 5 Drawing Sheets

(58) Field of Classification Search
CPC ..... A63B 21/4045; A63B 21/4047; A63B 21/4049
See application file for complete search history.

(56) References Cited

U.S. PATENT DOCUMENTS

| | | | | |
|---|---|---|---|---|
| 5,749,812 | A | 5/1998 | Feciura | |
| 5,816,732 | A | 10/1998 | Nissen | |
| 6,126,292 | A | 10/2000 | Liu | |
| 6,551,222 | B1 | 4/2003 | Beaver | |
| 7,086,951 | B2 | 8/2006 | Chang | |
| 7,108,641 | B2 | 9/2006 | Pertegaz-Esteban | |
| 7,462,140 | B1 * | 12/2008 | Lombardozzi | A63B 5/20 482/108 |
| 7,789,809 | B2 | 9/2010 | Borth | |
| 7,794,369 | B1 | 9/2010 | Rivera, III | |
| 7,828,703 | B1 | 11/2010 | Boesch | |
| 7,976,438 | B1 | 7/2011 | Hsu | |
| 8,136,208 | B2 | 3/2012 | Borth | |
| 8,911,333 | B2 * | 12/2014 | Hunt | A63B 5/20 482/81 |
| 9,254,401 | B2 | 2/2016 | Rogers | |
| 9,381,391 | B1 | 7/2016 | Welty, II | |
| 9,320,932 | B2 | 8/2016 | Newman | |
| 9,427,613 | B2 * | 8/2016 | Jordan | A63B 5/20 |
| 9,492,699 | B2 * | 11/2016 | Carpinelli | A63B 5/20 |
| 9,808,665 | B1 * | 11/2017 | Demarais | A63B 21/4035 |
| 10,556,147 | B2 * | 2/2020 | Zhang | A63B 5/20 |
| 10,617,902 | B2 * | 4/2020 | Zhang | A63B 5/20 |
| 2005/0026749 | A1 * | 2/2005 | Pak | A63B 5/20 482/1 |
| 2014/0243164 | A1 | 8/2014 | Suplee | |

* cited by examiner

A - A

DETAIL A

JUMP ROPE HANDLE HAVING ROPE HINGE

RELATED APPLICATIONS

This application claims the benefit of priority of U.S. Provisional Application No. 62/522,632 filed Jun. 20, 2017, which is incorporated herein by reference.

BACKGROUND

Field

Embodiments related to jump ropes are disclosed. More particularly, embodiments related to jump ropes having rotatable components are disclosed.

Background Information

Jump ropes are exercise equipment used for play, exercise, training, and sport. Referring to FIG. 1, a pictorial view of a jumper using a jump rope is shown. A typical jump rope 100 includes a rope 102 and a handle 104 at either end of rope 102 for a jumper 106 to hold and control the swinging of rope 102 during jumping. Rope 102 may be fixed to handle 104 at both ends, and handle 104 may retain rope 102 as the rope swings around jumper 106.

A profile of rope 102 may depend on a jumping maneuver being performed by jumper 106. In the sport of speed rope skipping, jumper 106 may try to complete as many jumps as possible within a particular amount of time. For example, the jumper could complete as many as one hundred jumps during a thirty second interval. This jumping intensity requires substantial centripetal force to be transmitted to rope 102 in order to retain rope 102 in handle 104. When jumper 106 performs a normal jumping maneuver with handles 104 extended outward, the ends of rope 102 may extend orthogonally from handles 104 along a first rope profile 108A. However, when jumper 106 performs a trick maneuver, such as a crossover maneuver, handles 104 are moved inward across a midplane of the jumper's body, and the movement of handles 104 can cause rope 102 to bend into a new profile. For example, the rope may bend toward an oblique angle relative to handles 104 along a second rope profile 108B.

SUMMARY OF THE DESCRIPTION

Existing jump ropes that include rope ends fixed to handles, as described above with respect to FIG. 1, may experience significant material stress at the junction between the rope ends and the handles when performing trick maneuvers. Furthermore, changes in the rope profile may be unnaturally distorted by the fixed joint between the rope and handle, because the rope is unable to tilt at the handles and must extend orthogonal to the handles and then gradually transition to the outward angle during crossover maneuvers. Distortion of the rope profile can interfere with successful completion of the maneuver, or may limit rope speed. Thus, a handle is needed that allows high speed swinging of the rope about the jumper, and permits the rope to follow a natural path at any angle to the handle when performing trick maneuvers.

A jump rope, e.g., a speed rope, having a rope that can move with two degrees of freedom relative to a jump rope handle is described below. In an embodiment, the jump rope handle includes a head rotationally joined to a grip such that the head rotates about a first axis. The jump rope handle includes a rope hinge rotationally joined to the head. For example, the rope hinge may include a cylindrical outer surface that is mounted in a pivot hole extending through the head. The pivot hole may extend along a second axis, which may be orthogonal to the first axis. Thus, movement of the rope hinge may be constrained to pivoting about the second axis. More particularly, the rope hinge may have a single degree of freedom relative to the head and exactly two degrees of freedom relative to the grip. Accordingly, when the rope is fastened within the rope hinge and a jumper holds the grip to swing the rope, the rope can pivot about the second axis while simultaneously swinging around the first axis (and the jumper). The freedom of angular movement of the rope can allow the rope to adjust to a natural rope profile when the handles are moved inward or outward by a jumper, e.g., when performing a crossover maneuver.

The above summary does not include an exhaustive list of all aspects of the present invention. It is contemplated that the invention includes all systems and methods that may be practiced from all suitable combinations of the various aspects summarized above, as well as those disclosed in the Detailed Description below and particularly pointed out in the claims filed with the application. Such combinations have particular advantages not specifically recited in the above summary.

DETAILED DESCRIPTION

Embodiments describe jump ropes. However, while some embodiments are described with specific regard to speed ropes used in speed rope training, the embodiments are not so limited and certain embodiments may also be applicable to other activities, such as jump rope skipping.

In various embodiments, description is made with reference to the figures. Certain embodiments, however, may be practiced without one or more of these specific details, or in combination with other known methods and configurations. In the following description, numerous specific details are set forth, such as specific configurations and processes, in order to provide a thorough understanding of the present invention. In other instances, well-known processes and manufacturing techniques have not been described in particular detail in order to not unnecessarily obscure the present invention. Reference throughout this specification to "one embodiment," "an embodiment," or the like, means that a particular feature, structure, configuration, or characteristic described in connection with the embodiment is included in at least one embodiment of the invention. Thus, the appearances of the phrase "one embodiment," "an embodiment," or the like, in various places throughout this specification are not necessarily referring to the same embodiment of the invention. Furthermore, the particular features, structures, configurations, or characteristics may be combined in any suitable manner in one or more embodiments.

In an aspect, a jump rope includes a rope attached to one or more handles. The handle(s) include a grip, a head rotationally joined to the grip, and a rope hinge rotationally joined to the head. More particularly, the head has a single degree of freedom relative to the grip, and the rope hinge has a single degree of freedom relative to the head. The rope can be mounted on the rope hinge, e.g., in a retainer hole of the rope hinge, and thus, the rope can pivot relative to the head and rotate around the grip. That is, the head permits the rope to rotate about a first axis relative to the grip, and the rope hinge permits the rope to pivot about a second axis relative to the head. The relative movements of the grip, head, and rope hinge can impart several degrees of freedom between the rope and the grip such that the rope can tilt inward or outward to take a natural swinging profile as the rope is swung around a jumper during a crossover maneuver.

Figure 1:
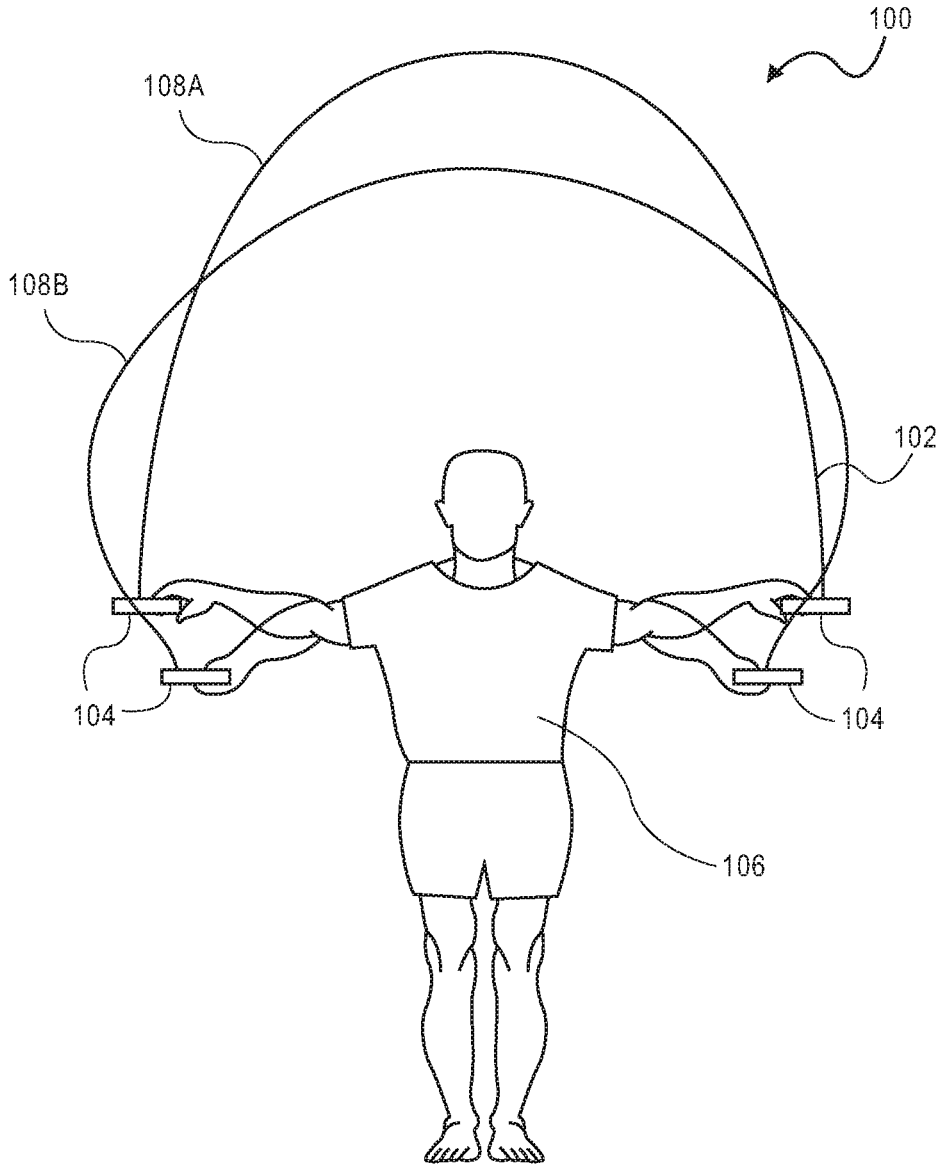
FIG. 1 is a pictorial view of a jumper using a jump rope.
Figure 2:
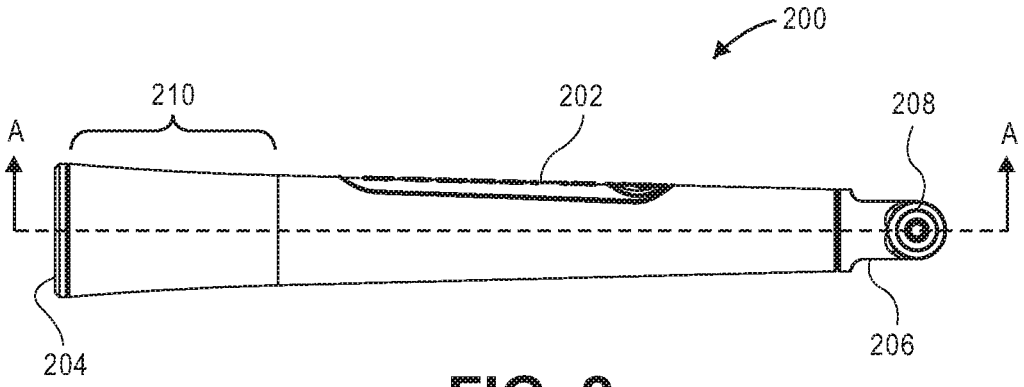
FIG. 2 is a side view of a jump rope handle, in accordance with an embodiment.

Referring to FIG. 2, a side view of a jump rope handle is shown in accordance with an embodiment. A handle 200 can include several components, and each component can move relative to one or more of the other components. Handle 200 may include a grip 202 extending longitudinally between an end cap 204 and a head 206. Head 206 can be rotationally joined to grip 202, such that head 206 rotates about a longitudinal axis extending through grip 202 in a longitudinal direction. Handle 200 may include a rope hinge 208 mounted on head 206. Rope hinge 208 may also rotate about the longitudinal axis extending through grip 202 in the longitudinal direction. Furthermore, rope hinge 208 may be rotationally joined to head 206, such that rope hinge 208 pivots about a transverse axis extending through head 206 transverse to the longitudinal direction.

Handle 200 may have a shape and size well-suited for high intensity jumping. For example, grip 202 may be shaped to allow a jumper to securely hold handle 200. In an embodiment, an outer surface of grip 202 is a tapered cylinder and/or includes frustoconical portions. The outer surface may be contoured to conform to a hand grip of a jumper. The outer surface may also be modified to improve handling, such as by incorporating knurled or roughened surfaces. Furthermore, grip 202 may be overmolded, coated, or covered with materials that are easy to grip, such as foam, rubber, etc. To further improve handling, handle 200 may include a foot 210, i.e., a proximal region of grip 202 leading to end cap 204 that has a wider cross-sectional dimension than a central region of grip 202 to prevent handle 200 from being pulled from a jumper's hand by the momentum of a swinging rope. Foot 210 may extending proximally from a distal region of grip 202 leading up to head 206. Foot 210 may transition smoothly into the central or distal region of grip 202 over a length of handle 200. The length of handle 200 may be in a range of 5-7 inches, e.g., 6 inches. One or more components of handle 200 may be fabricated from metal, e.g., aluminum, or plastic, e.g., polypropylene. Handle 200 may be lightweight, e.g., less than 5 ounces.

Figure 3:
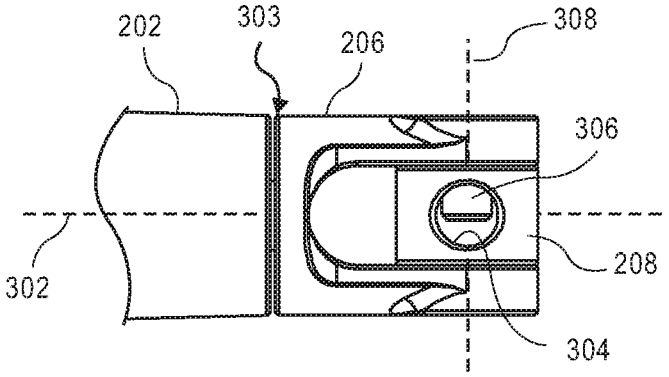
FIG. 3 is a top view of an end of a jump rope handle, in accordance with an embodiment.

Referring to FIG. 3, a top view of an end of a jump rope handle is shown in accordance with an embodiment. Grip 202 may extend in the longitudinal direction along a first axis 302 from end cap 204 to a distal end. In an embodiment, head 206 is rotationally joined to grip 202 at the distal end. A distal face of grip 202 may abut a proximal face of head 206 at an interface 303. More particularly, head 206 can be supported by grip 202 at the distal end, and head 206 may rotate about first axis 302. Accordingly, when a rope attached to head 206 swings around a jumper, head 206 spins about first axis 302.

In an embodiment, rope hinge 208 includes a rope hole 304. Rope hole 304 may extend through rope hinge 208, and can be sized to receive a rope. For example, rope hole 304 can have a diameter up to 10 mm, e.g., 5 mm or less, to receive a cord or cable having a diameter up to the size of the diameter of rope hole 304. Accordingly, head 206 can accept a variety of rope sizes. In an embodiment, the rope is held in place within rope hole 304 by a set screw 306. More particularly, set screw 306 may be advanced or retracted along a second axis 308 to reduce or increase a space within rope hole 304. When set screw 306 is advanced, a tip of set screw 306 may squeeze the rope against an inner surface of rope hinge 208 surrounding rope hole 304, and when set screw 306 is retracted, the tip of set screw 306 may release the rope. By releasing the rope, inserting a desired length of rope through rope hole 304, and then squeezing the rope within rope hinge 208 by set screw 306, a user of jump rope may adjust a length of rope being swung about the jumper.

Figure 4:
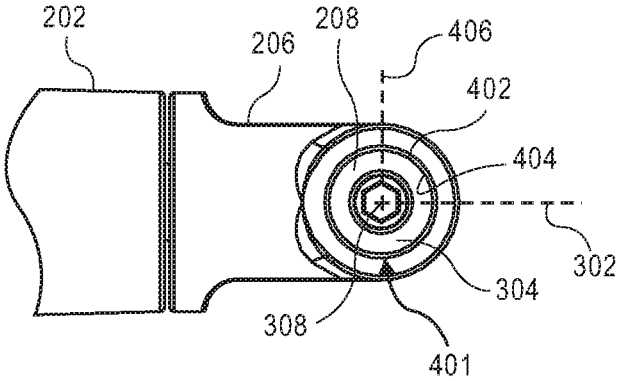
FIG. 4 is a side view of an end of a jump rope handle, in accordance with an embodiment.

Referring to FIG. 4, a side view of an end of a jump rope handle is shown in accordance with an embodiment. Rope hinge 208 can be rotationally joined to head 206 such that rope hinge 208 only rotates about second axis 308. More particularly, movement of rope hinge 208 may be constrained by an interface 401 between head 206 and rope hinge 208. In an embodiment, rope hinge 208 includes a cylindrical outer surface 402 mounted within head 206. More particularly, head 206 may include a pivot hole 404 extending along second axis 308, and cylindrical outer surface 402 may be mounted in pivot hole 404. Accordingly, a rope held within rope hole 304 extending along a third axis 406 may pivot about second axis 308 when rope hinge 208 rotates about second axis 308.

The referential axes described above may have predetermined relationships to each other. For example, first axis 302 about which head 206 rotates may be orthogonal to second axis 308 about which rope hinge 208 pivots. Similarly, third axis 406 along which rope hole 304 extends through rope hinge 208 may be orthogonal to second axis 308. The orthogonal relationship between third axis 406 and second axis 308 may remain constant during use of handle 200, i.e., as the rope swings around the jumper. Other referential relationships, however, may vary. For example, third axis 406 may be orthogonal to first axis 302 under some circumstances, e.g., when a jumper is performing a normal jumping maneuver (and when handle 200 is in the state illustrated in FIG. 4). By contrast, and the angle between third axis 406 and first axis 302 may be oblique, e.g., when the jumper is performing a crossover jumping maneuver. In either instance, however, first axis 302 and third axis 406 may be within a plane. That is, first axis 302 and third axis 406 may define a plane that the rope tilts or pivots inward and outward within during use (such as the plane of the drawing sheet containing FIG. 4).

Handle 200 having a dual bearing system, i.e., a first bearing rotationally coupling head 206 to grip 202 and a second bearing rotationally coupling rope hinge 208 to head 206, can optimize an ability of the rope to take a natural profile during jumping maneuvers. Furthermore, the angular freedom of the rope can translate to faster spinning of the rope about the jumper, and increased control of the rope by the jumper. More particularly, the angular movement of the rope can provide an ability for the rope to adjust to changes in handle position, e.g., when the jumper moves handles 200 inward during a crossover maneuver. The angular freedom of the rope can be achieved by providing several degrees of freedom between rope hinge 208 and grip 202. In an embodiment, rope hinge 208 has a single degree of freedom relative to head 206, and head 206 has a single degree of freedom relative to grip 202. Thus, rope hinge 208 may have two degrees of freedom relative to grip 202. A "single degree of freedom," as referred to herein may mean exactly or only one degree of freedom. For example, one skilled in the art will recognize that a hinge kinematic joint has a single degree of freedom. By contrast, a spherical pair kinematic joint has three degrees of freedom (and thus, does not have a single degree of freedom). Accordingly, rope hinge 208 may have no more than two degrees of freedom relative to grip 202. Two degrees of freedom between the rope and grip 202 can be sufficient to achieve the benefits described above, and may represent an optimal manner of achieving the benefits using a design without excess kinematic joints.

Figure 5:
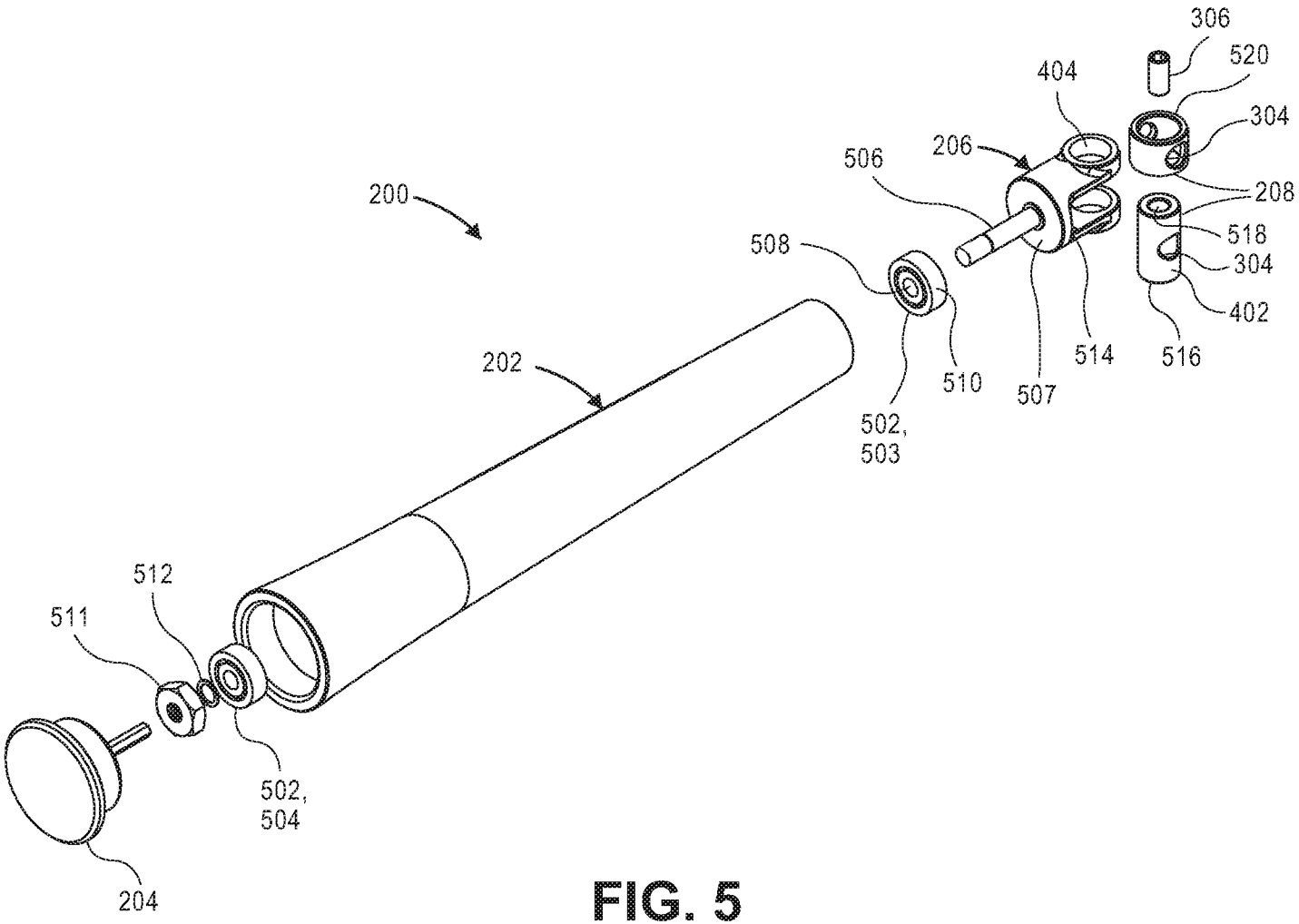
FIG. 5 is an exploded view of a jump rope handle, in accordance with an embodiment.

Referring to FIG. 5, an exploded view of a jump rope handle is shown in accordance with an embodiment. Head 206 may be rotationally joined to grip 202 by one or more bearings 502. For example, handle 200 may include a first bearing 503 axially separated from a second bearing 504. The bearings 502 may be mounted within grip 202, and may support head 206, as described below. Each bearing 502 may have a bearing inner surface 508 mounted on a portion of head 206, and a bearing outer surface 510 mounted on a portion of grip 202. The bearings 502 may include a distal bearing, e.g., first bearing 503, and a proximal bearing, e.g., second bearing 504, that are each selected from a group consisting of a plain bearing, a rolling bearing, a fluid bearing, and a magnetic bearing. For example, at least one of the distal bearing or the proximal bearing may include a rolling bearing. In an embodiment, first bearing 503 and second bearing 504 are rolling bearings.

In an embodiment, head 206 includes a shaft 506 extending proximally from a base surface 507. Shaft 506 may be mounted on first bearing 503 and second bearing 504, as described below. For example, shaft 506 may be mounted on bearing inner surfaces 508 of first bearing 503 and second bearing 504. Shaft 506 can be a cylindrical extension having a constant cross-sectional profile, e.g., a same outer diameter over a length of shaft 506.

Shaft 506 may be retained within bearings 502 by a shaft fastener 511. For example, shaft fastener 511 may be a nut that screws onto a threaded end of shaft 506, or a pin that passes through shaft 506 orthogonal to first axis 302. An interference between shaft fastener 511 and second bearing 504 may prevent head 206 from ejecting out of grip 202 during use.

Handle 200 may include other components to minimize friction between head 206, bearings 502, or grip 202. For example, handle 200 may include a shim 512 between shaft fastener 511 and second bearing 504. Shim 512 may be an annular disc, and may be fabricated from a low-friction material, e.g., polytetrafluoroethylene or aluminum, to minimize friction between the components during use.

Rope hinge 208 may be rotationally joined to head 206 by a hinge kinematic joint. Head 206 may include a portion extending in a distal direction from base surface 507. For example, one or more extensions may extend forward from grip 202. In an embodiment, head 206 includes a fork 514 having several prongs that extend along first axis 302. One or more of the prongs of fork 514 can be configured to receive a portion of rope hinge 208 to form a hinge structure. For example, fork 514 can include pivot hole 404 defined by a cylindrical inner surface in one or more prongs of fork 514. Cylindrical outer surface 402 of rope hinge 208 may insert into pivot hole 404 to slide relative to the cylindrical inner surface to form the hinge structure.

In an embodiment, rope hinge 208 includes several components. For example, rope hinge 208 may include a barrel 516 having cylindrical outer surface 402. More particularly, barrel 516 may be cylindrical and include cylindrical outer surface 402, and optionally, a cylindrical inner surface separated from cylindrical outer surface 402 by a wall. In an embodiment, barrel 516 is a solid cylinder, however, one or more holes extend through barrel 516. For example, rope hole 304 may extend through barrel 516 along third axis 406 orthogonal to second axis 308. Similarly, a threaded hole 518 may extend along second axis 308 from an end face of barrel 516. Threaded hole 518 may intersect rope hole 304 such that set screw 306 can be screwed into threaded hole 518 to fasten the rope within rope hole 304.

Rope hinge 208 may include a sleeve 520 that fits around barrel 516 and retains barrel 516 within fork 514. More particularly, sleeve 520 may have a hollow shape, e.g., a hollow cylinder, having a cylindrical inner surface that conforms to cylindrical outer surface 402 of barrel 516. Rope hole 304 may pass through a wall of sleeve 520 and be aligned with rope hole 304 in barrel 516. In an embodiment, sleeve 520 and barrel 516 are fixed to each other, e.g., by a press fit or an adhesive or thermal bond. Sleeve 520 may be larger than pivot hole 404, and thus, may be held between fork 514 and may retain barrel 516 within fork 514 to form the hinge kinematic joint between rope hinge 208 and head 206.

Figure 6:
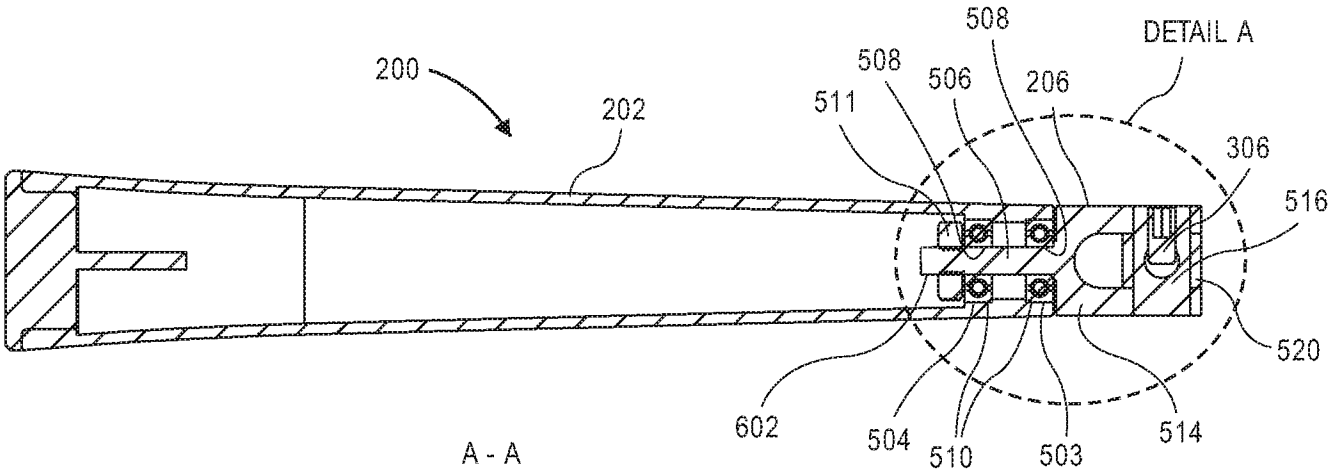
FIG. 6 is a cross-sectional view, taken about line A-A of FIG. 2, of a jump rope handle, in accordance with an embodiment.

Referring to FIG. 6, a cross-sectional view, taken about line A-A of FIG. 2, of a jump rope handle is shown in accordance with an embodiment. Each bearing 502 may be mounted within grip 202 of the assembled handle 200. For example, first bearing 503 and second bearing 504 may be rolling bearings having an outer race and an inner race. Outer bearing surfaces 510 of the outer races can be press fit or adhered to an inner surface of grip 202. Similarly, shaft 506 can be press fit or adhered to bearing inner surfaces 508 of the inner races. Bearing inner surfaces 508 may have a same inner diameter. Accordingly, shaft 506 may include a shaft outer surface 602 having a same diameter over the portions mounted on bearing inner surfaces 508. For example, shaft outer surface 602 may be cylindrical and have a constant diameter over a length of shaft 506. Alternatively or additionally, at least one of the distal bearing 503 or the proximal bearing 504 may include a plain bearing having the bearing outer surface 510 and the bearing inner surface 508.

One or more of the rolling bearings 502 may include a thrust bearing to support axial loading of the bearing system. For example, second bearing 504 may be a thrust bearing that resists axial loading in a first direction along first axis 302, e.g., in a leftward direction of FIG. 6. Axial loading in a second direction opposite to the first direction may be resisted by shaft fastener 511. More particularly, shaft fastener 511 can be mounted on shaft 506 to resist removal of shaft 506 from bearings 502 in a rightward direction of FIG. 6.

Figure 7:
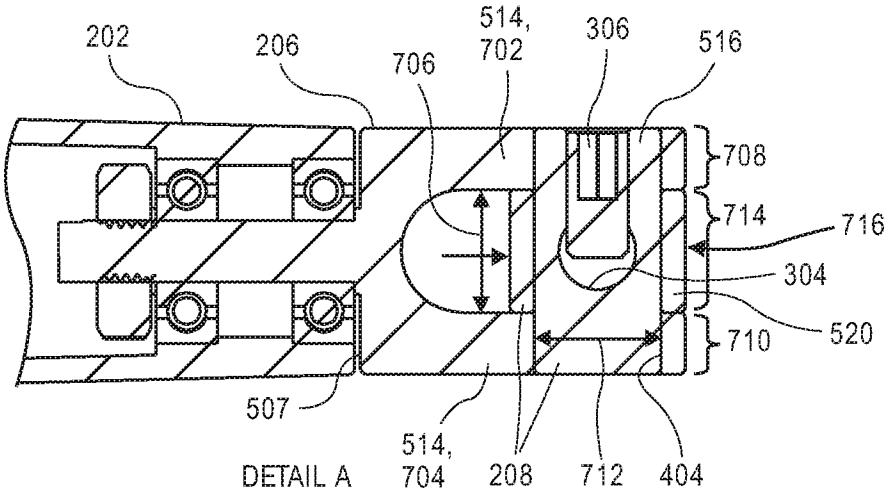
FIG. 7 is a detail view, taken from Detail A of FIG. 6, of an end of a jump rope handle, in accordance with an embodiment.

Referring to FIG. 7, a detail view, taken from Detail A of FIG. 6, of an end of a jump rope handle is shown in accordance with an embodiment. Rope hinge 208 may rotate freely about second axis 308 within head 206. In an embodiment, fork 514 of head 206 includes a first prong 702 and a second prong 704 extending forward from a distal end of grip 202 along first axis 302. First prong 702 and second prong 704 may extend forward from base surface 507 of head 206 that shaft 506 extends proximally from. First prong 702 and second prong 704 may be separated in a transverse direction by a gap 706 orthogonal to first axis 302. A portion of rope hinge 208 may fit within gap 706, and a portion of rope hinge 208 may be held in place within pivot hole 404, which extends through first prong 702 and second prong 704.

As described above, rope hinge 208 may include sleeve 520 joined, e.g., coupled, attached, fastened, connected, etc., to barrel 516. It will be appreciated, however, that rope hinge 208 may be a monolithic component having a shape of the combined barrel 516 and sleeve 520 components. For example, rope hinge 208 may include a first end portion 708 to fit in pivot hole 404 of first prong 702. Similarly, rope hinge 208 may include a second end portion 710 to fit within pivot hole 404 of second prong 704. First end portion 708 and second end portion 710 may be cylindrical and have outer diameters that form a sliding fit with pivot hole 404. More particularly, the outer diameters may be smaller than a hole diameter 712 of pivot hole 404. By contrast, rope hinge 208 may include a central portion 714 held between first prong 702 and second prong 704. Central portion 714 can be held in place by a mechanical interference between a sidewall of central portion 714 and a sidewall of each fork 514 prong. More particularly, central portion 714 can have an outer diameter 716 that is greater than hole diameter 712 of pivot hole 404. Accordingly, lateral loading on rope hinge 208 can be resisted by interference between central portion 714 and the fork prongs such that rope hinge 208 is retained by head 206 as rope hinge 208 pivots within head 206. Rope hole 304 can extend through rope hinge 208 between first prong 702 and second prong 704, and thus, the rope held within rope hole 304 by set screw 306 can pivot about second axis 308 as the rope (and head 206) rotates about first axis 302.

Figure 8:
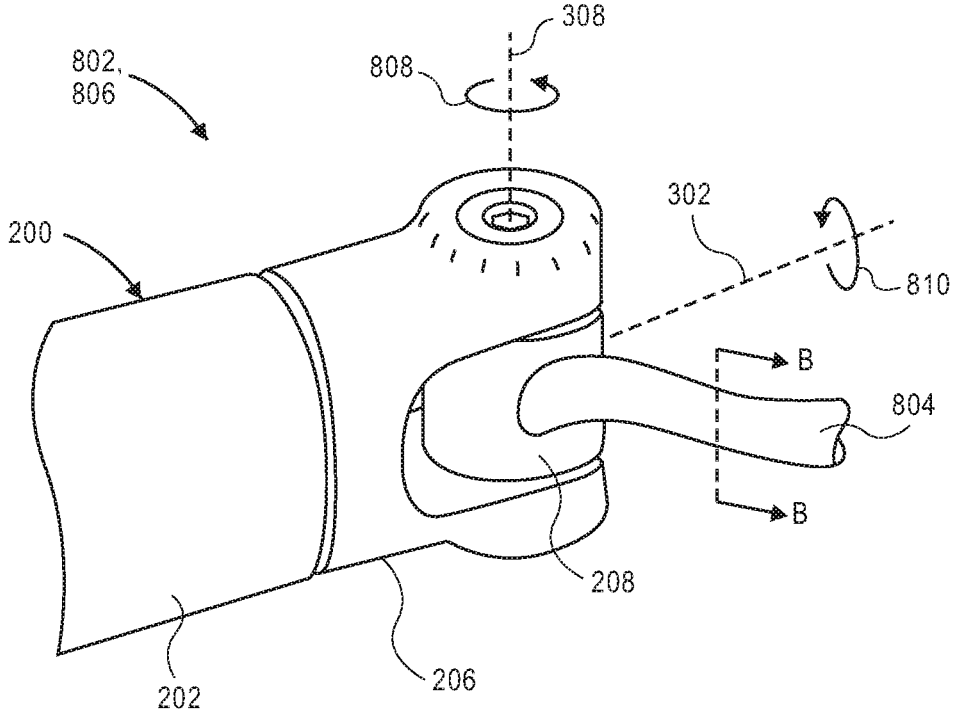
FIG. 8 is a perspective view of a portion of a jump rope having several degrees of freedom, in accordance with an embodiment.

Referring to FIG. 8, a perspective view of a portion of a jump rope having several degrees of freedom is shown in accordance with an embodiment. A jump rope 802 can be an assembly of handle 200 and a rope 804. That is, when rope 804 is held in rope hole 304 of rope hinge 208, jump rope 802 is formed. Rope 804 can have two ends, and each end may be held in a respective handle 200. Jump rope 802 may be a speed rope 806. Classification of jump rope 802 as a speed rope 806 may be based on a type of rope 804 held by handle 200. For example, when handle 200 holds rope 804 described with respect to FIG. 9A below, jump rope 802 may be classified as a jump rope 802. By contrast, when handle 200 holds rope 804 described with respect to FIG. 9B below, jump rope 802 may be classified as speed rope 806.

Jump rope 802 incorporates the dual coupling system described above. For example, a first coupling, e.g., first bearing 503 and second bearing 504, connects grip 202 to head 206, and a second coupling, e.g., rope hinge 208, connects rope 804 to head 206. The couplings of the system may be spaced apart from each other to resist binding from radial loads. For example, second axis 308 extending through rope hinge 208 can be longitudinally spaced from first bearing 503 by a distance to resist binding from radial loads. The spacing between the couplings, however, may be close enough to minimize rotational mass of the dual coupling system. For example, second axis 308 extending through rope hinge 208 can be longitudinally spaced from first bearing 503 by a distance to minimize rotational mass.

The dual coupling system of jump rope 802 provides rope 804 with several degrees of freedom. Rope 804 can pivot about second axis 308 when rope hinge 208 rotates about second axis 308 relative to head 206. The pivoting movement of rope 804 is a first degree of freedom 808. Rope 804 can also swing about first axis 302 when head 206 rotates about first axis 302 relative to grip 202. The swinging movement of rope 804 is a second degree of freedom 810. Accordingly, a rope angle between rope 804 and first axis 302 can increase and decrease as rope 804 tilts inward or outward during crossover maneuvers, and rope 804 may remain orthogonal to second axis 308 as rope 804 swings around the jumper. The freedom of movement afforded rope 804 is achieved by the single degree of freedom provided by the hinge kinematic joint connecting rope hinge 208 to head 206.

Figure 9A:
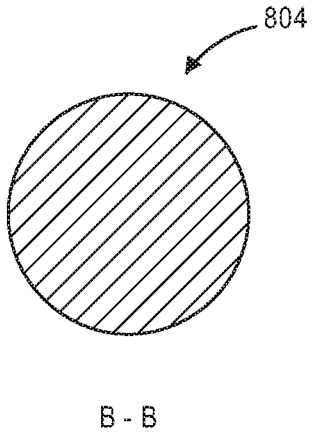
FIGS. 9A-9B are cross-sectional views, taken about line B-B of FIG. 8, of a rope, in accordance with an embodiment.

Referring to FIG. 9A, a cross-sectional view, taken about line B-B of FIG. 8, of a rope is shown in accordance with an embodiment. Rope 804 may be a cable or cord sized to fit within rope hole 304. For example, rope 804 may be a cable having several wires or strands twisted together, or rope 804 may be a cord having a solid core (FIG. 9A) In an embodiment, rope 804 has a diameter in a range of 1-5 mm. For example, rope 804 may be a cable having a diameter of 1.2 mm, or rope 804 may be a cord having a diameter of 4 mm. The cable or cord may be fabricated from a variety of materials, including polyvinyl chloride by way of example. The cable or cord may be pinched between set screw 306 and an inner surface of rope hinge 208 surrounding rope hole 304 to secure rope 804 to rope hinge 208 of jump rope 802.

Figure 9B:
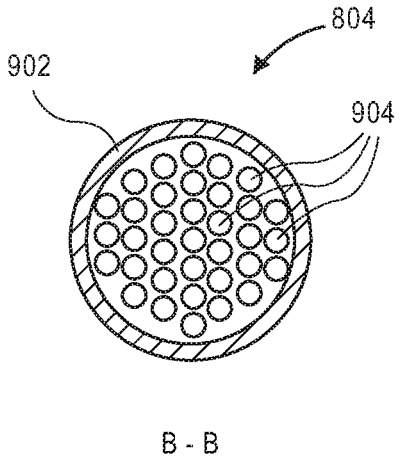

Referring to FIG. 9B, a cross-sectional view, taken about line B-B of FIG. 8, of a rope is shown in accordance with an embodiment. Rope 804 may include a rope jacket 902 surrounding several rope strands 904. For example, rope jacket 902 may be a tubular jacket formed from a flexible material, e.g., a thin nylon material, and rope strands 904 may be stranded or braided strands of wire, e.g., steel wires, that include interstitial gaps 706 between the wires. Rope jacket 902 may include an outer rope surface that is pinched between set screw 306 and an inner surface of rope hinge 208 surrounding rope hole 304 to secure rope 804 to rope hinge 208 of speed rope 806.

In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. A jump rope handle, comprising:

a grip extending along a first axis;

a head rotationally coupled to the grip, wherein the head rotates about the first axis, and the head includes:

a fork having a first prong and a second prong; and a pivot hole extending along a second axis and through the first prong and the second prong;

a rope hinge rotationally coupled to the head and mounted in the pivot hole in the first prong and the second prong to constrain movement of the rope hinge to a single degree of freedom relative to the head, wherein the single degree of freedom is rotation of the rope hinge about the second axis, and the rope hinge includes:

a rope hole extending through the rope hinge along a third axis orthogonal to the second axis; and wherein the rope hole extends through the rope hinge between the first prong and the second prong.

2. The jump rope handle of claim 1, wherein the rope hinge has a cylindrical outer surface mounted in the pivot hole in the first prong and the second prong to to constrain the movement of the rope hinge to the rotation about the second axis.

3. The jump rope handle of claim 2, wherein the rope hinge includes a threaded hole that extends along the second axis and intersects the rope hole.

4. The jump rope handle of claim 2, wherein the second axis is orthogonal to the first axis, and wherein the first axis and the third axis are within a plane.

5. The jump rope handle of claim 2, wherein the head is rotationally coupled to the grip by one or more bearings, and wherein each of the one or more bearings includes a bearing inner surface on the head and a bearing outer surface on the grip.

6. The jump rope handle of claim 5, wherein the one or more bearings is a plurality of rolling bearings.

7. The jump rope handle of claim 6, wherein the head includes a shaft mounted on the bearing inner surfaces.

8. The jump rope handle of claim 2, wherein the first prong and the second prong extending along the first axis.

9. The jump rope handle of claim 8, wherein the rope hinge includes: a first end portion in the pivot hole of the first prong, a second end portion in the pivot hole of the second prong, and a central portion between the first prong and the second prong, and wherein one or more of the first end portion or the second end portion include the cylindrical outer surface.

10. The jump rope handle of claim 9, wherein the central portion of the rope hinge has an outer diameter greater than a hole diameter of the pivot hole.

11. The jump rope handle of claim 1, wherein the rope hinge has no more than two degrees of freedom relative to the grip.

12. A jump rope, comprising:

a handle including a grip extending along a first axis, a head rotationally coupled to the grip, wherein the head rotates about the first axis, and the head includes:

a fork having a first prong and a second prong; and a pivot hole extending along a second axis and through the first prong and the second prong;

a rope hinge rotationally coupled to the head and mounted in the pivot hole in the first prong and the second prong to constrain movement of the rope hinge to a single degree of freedom relative to the head, wherein the single degree of freedom is rotation of the rope hinge about the second axis, and wherein the rope hinge includes:

a rope hole extending through the rope hinge along a third axis orthogonal to the second axis;

wherein the rope hole extends through the rope hinge between the first prong and the second prong; and a rope in the rope hole.

13. The jump rope of claim 12 wherein the rope hinge has a cylindrical outer surface mounted in the pivot hole in the first prong and the second to constrain the movement of the rope hinge to the rotation about the second axis.

14. The jump rope of claim 13, wherein the head is rotationally coupled to the grip by a plurality of rolling bearings, wherein each of the plurality of rolling bearings includes a bearing inner surface on the head and a bearing outer surface on the grip, and wherein the head includes a shaft mounted on the bearing inner surfaces of the plurality of rolling bearings.

15. The jump rope of claim 13, wherein the first prong and the second prong extend along the first axis.

16. The jump rope of claim 15, wherein the rope hinge includes: a first end portion having the cylindrical outer surface in the pivot hole of the first prong, and a central portion between the first prong and the second prong, and wherein the central portion has an outer diameter greater than a hole diameter of the pivot hole.

17. A speed rope, comprising:

a handle including;

a grip extending along a first axis, a head rotationally coupled to the grip, wherein the head rotates about the first axis, and the head includes:

a fork having a first prong and a second prong; and a pivot hole extending along a second axis and through the first prong and the second prong;

a rope hinge rotationally coupled to the head and mounted in the pivot hole in the first prong and the second prong to constrain movement of the rope hinge to a single degree of freedom relative to the head, wherein the single degree of freedom is rotation of the rope hinge about the second axis, and wherein the rope hinge includes:

a rope hole extending through the rope hinge along a third axis orthogonal to the second axis;

wherein the rope hole extends through the rope hinge between the first prong and the second prong; and a rope in the rope hole, wherein the rope includes a rope jacket around a plurality of rope strands.

18. The speed rope of claim 17, wherein the rope hinge has a cylindrical outer surface mounted in the pivot hole in the first prong and the second prong to constrain the movement of the rope hinge to the rotation about the second axis.

19. The speed rope of claim 18, wherein the head is rotationally coupled to the grip by a plurality of rolling bearings, wherein the plurality of rolling bearings include respective bearing inner surfaces having a same inner diameter, and wherein the head includes a shaft having a shaft outer surface mounted on the bearing inner surfaces.

20. The speed rope of claim 18, wherein the first prong and the second prong extend along the first axis, wherein the rope hinge includes:

a first end portion having the cylindrical outer surface in the pivot hole of the first prong, and a central portion between the first prong and the second prong, and wherein the central portion has an outer diameter greater than a hole diameter of the pivot hole.

* * * * *